United States Patent [19]

Davis

[11] 4,115,885

[45] Sep. 26, 1978

[54] WATER CUSHION AND METHOD OF USING THE SAME

[76] Inventor: Charles E. Davis, 714 N. Lazard, San Fernando, Calif. 91340

[21] Appl. No.: 828,527

[22] Filed: Aug. 29, 1977

[51] Int. Cl.[2] ..... A47C 27/08

[52] U.S. Cl. ..... 5/349; 5/370; 297/DIG. 3

[58] Field of Search ..... 297/459, DIG. 3, 219; 5/349, 348, 365, 366, 367, 370

[56] References Cited

U.S. PATENT DOCUMENTS

| | | | |
|---|---|---|---|
| 484,367 | 10/1892 | Hicks | 5/365 |
| 697,279 | 4/1902 | Schmied | 5/366 |
| 726,164 | 4/1903 | Hogan et al. | 5/365 |
| 1,468,072 | 9/1923 | Ogle | 5/365 |
| 3,112,956 | 12/1963 | Schick et al. | 5/349 X |
| 3,115,647 | 12/1963 | Emery | 297/DIG. 3 |
| 3,296,635 | 1/1967 | O'Hanlan | 5/349 X |
| 3,983,587 | 10/1976 | Gorran | 5/370 |

*Primary Examiner*—Francis K. Zugel
*Attorney, Agent, or Firm*—Huebner & Worrel

[57] ABSTRACT

A water cushion particularly suited for use in supporting a human body in a seated disposition in an automobile, wheel chair and the like with a greater degree of safety. The cushion includes a flexible envelope adapted to be filled with water including a first zone configured to receive in supporting relation the buttock of a seated person and having defined therein an unbaffled chamber, and a second zone for receiving in supporting relation the thighs of the person having defined therein a plurality of chambers arranged in mutual parallelism and communicating with the chamber of the first zone, whereby the rigidity of the second zone is enhanced as the pressure applied by the weight of the person is increased.

1 Claim, 4 Drawing Figures

WATER CUSHION AND METHOD OF USING THE SAME

BACKGROUND OF THE INVENTION

1. Field of the Invention

The invention generally relates to cushions and more particularly to a water cushion for safely supporting a person in a moving vehicle in a manner such that the health and physical well being of the person is enhanced.

2. Description of the Prior Art

The prior art, of course, is replete with disclosures of cushions intended to support a human body. Such include pillow-like devices filled with feathers, foam air and the like. However, as can be fully appreciated by those familiar with a use of known cushions over extended periods of time, such as vehicle drivers, invalids confined to wheel chairs, and the like, reduced circulation often results in discomfort with an attendant general tightening of the muscles throughout the region of the user's neck, back and buttocks.

In attempting to overcome the inadequacies characterizing known cushions, an attempt to fill a flexible envelope with water was made, since the hardness of such a cushion can readily be established simply by filling the envelope with a predetermined quantity of water. Additionally, it was found that water confined within a flexible envelope tends to move about and thus has a capability for enhancing circulation and for thus relaxing muscles found in the neck and back of the user. As should readily be apparent, one characteristic of a flexible envelope filled with water is its inherent flexibility, normally a desirable characteristic. However, when employing a flexible envelope filled with water, particularly where the resulting water cushion is deployed on the seat of a moving vehicle such as a wheel chair or, as a practical matter, on the seat of an automobile, braking the vehicle tends to induce in the cushion rolling motion for thus causing the cushion, in effect, to "roll" forward creating a hazardous condition for the user, particularly where the user is a so-called invalid.

Consequently, it should be apparent that there currently exists a need for a flexible water cushion having a capability for safely supporting a user in a moving vehicle such as a wheel chair, automobile or the like.

It is therefore the general purpose of the instant invention to provide a water cushion particularly suited for use in comfortably and safely supporting a user in a moving vehicle.

OBJECTS AND SUMMARY OF THE INVENTION

It is an object of the instant invention to provide a water cushion which overcomes the aforementioned difficulties and disadvantages, without sacrificing the advantages thereof.

It is another object to provide a method for employing a water cushion.

It is another object to provide a water cushion having a capability of comfortably and safely supporting a user in a vehicle such as a wheel chair and the like.

It is another object to provide a water cushion characterized by a therapeutic capability and adapted to safely support a user on a moving vehicle in a manner such that as pressure is increased due to momentum of the user, rigidity of the cushion is enhanced.

It is another object to provide a water cushion particularly suited for use in confortably and safely supporting a user in a seated disposition compromising a first zone including an unbaffled chamber and adapted to receive the buttocks of the user and a contiguously related second zone including a plurality of chambers extended in mutual parallelism simultaneously to communicate with the unbaffled chamber, whereby increased pressure applied to the cushion at the first zone resulting from the momentum of the body increases the hydrostatic pressure in the second zone whereby the capability of withstanding deformation is enhanced, as will become more readily apparent by reference to the following description and claims in light of the accompanying drawings.

DESCRIPTION OF THE PREFERRED EMBODIMENT

Figure 1:
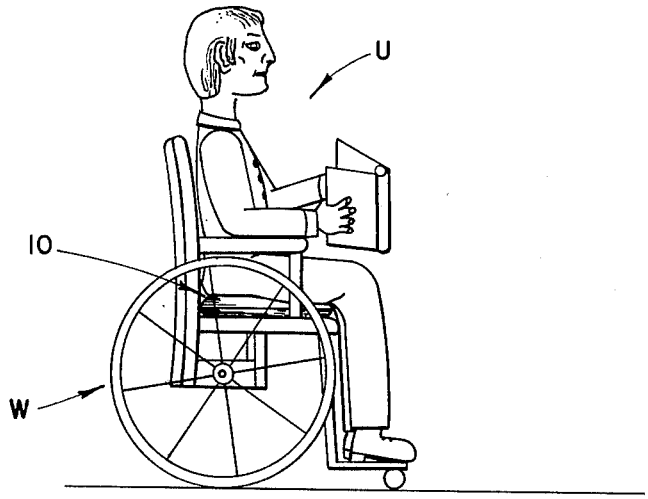
FIG. 1 is a pictorial view illustrating an environment in which a water cushion embodies the principles of the instant invention which is particularly suited for use.

Referring now to the drawings wherein like characters designate like or corresponding parts throughout the several view there shown. In FIG. 1 a wheel chair W of known design, having a seat upon which is disposed a cushion 10 embodying the principles of the instant invention.

It is important here to note that the cushion 10 has utility in numerous and various environments. For example, the cushion 10 is readily employable for supporting a user seated in the driver's seat of an automobile.

The cushion 10 preferably is formed of an impervious material capable of withstanding substantial stress without stretching and yet possess heat-sealing characteristics sufficient to facilitate bonding under heat and pressure. A material suitable for such purpose is polyvinyl chloride.

The cushion 10 preferably is formed as a heated sealed envelope having defined therein a first zone, generally designated 12, and a second zone generally designated 14. Within the zone 12 there is defined an unbaffled chamber, not shown, while the second zone 14 includes a plurality of linearly extended seams 16, formed as by heat sealing or the like. It is important to note that each of the seams 16 terminates at one end thereof within the periphery of the envelope 12, while the opposite end of the seam terminates in an expanded area 18. The expanded area 18 serves to distribute stress in order to avoid rupturing of the material from which the envelope is formed. Moreover, where desired, the envelope 12 is formed by mating a pair of registered sheets and providing a peripheral seal 20 which serves to establish an endless seam for joining the sheets at their peripheries.

Finally, the cushion 10 is provided with a suitable filler neck 22 closed by a cap 24 of suitable design. Since the purposes of the filler neck 22 and the cap 24 are simply to close the envelope, and are of a suitable commercially available design, a detailed discussion of the neck and cap is omitted in the interest of brevity.

Figure 2:
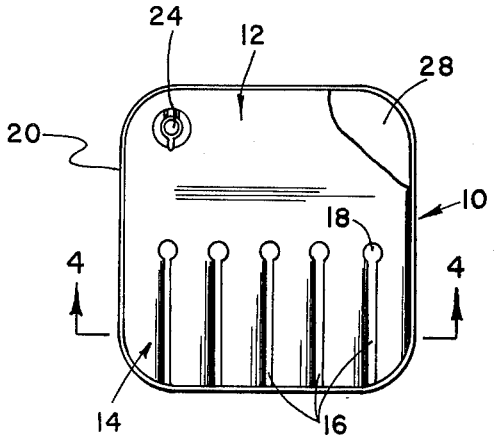
FIG. 2 is a top plan view of the water cushion.
Figure 4:
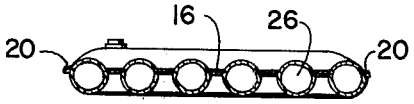
FIG. 4 is a cross sectional view taken generally along lines 4—4 of FIG. 2.
Figure 3:
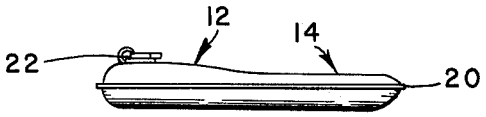
FIG. 3 is a side elevational view of the water cushion.

Turning now to FIG. 2, it can be seen that the seams 16 are arranged in parallelism and, in effect, establish a plurality of elongated chambers 26, each being of a tubular configuration which communicates with an unbaffled chamber 28 located within the zone 12. The zone 12, of course, is suitably dimensioned to receive in supporting relation the buttocks of a user while the zone 14 is suitably dimensioned for receiving the thighs of the user, also in supporting relation. Finally, it also should be noted that the cushion 10 is substantially filled with a fluid, such as water, heated to a desired temperature.

With the cushion 10 fabricated in the manner hereinbefore described, employing heat sealing dies and the like, it is prepared for usage simply by lifting the cap 24 from the filler neck 22 and introducing into the chamber 28 a fluid such as water, preferably heated to a preselected temperature. Of course, as the water enters the envelope a portion of it passes from the unbaffled chamber 28 of the first zone into the chambers 26 for partially filling the entirety of the envelope. The extent to which the envelope 10 is filled determines, in effect, the softness of the cushion.

The resulting cushion is then deposited at a point beneath a user with the chambers 26 being extended beneath the thighs of the user, in substantial parallelism therewith, while the chamber 28 is positioned beneath the buttocks of the user. As can be appreciated, the greater the weight applied to the first zone 12 the greater will be the hydrostatic pressure of the liquid confined within the chambers 26. The greater, of course, the hydrostatic pressure of the fluid within the chambers 26, the greater will be the rigidity of the cushion within the zone 14.

Therefore, it should be apparent that when with a user seated on a cushion disposed within a moving vehicle, a braking of the vehicle will cause the user to slide in a generally downward and forward direction causing the fluid within the chamber 28 to move toward and into the chambers 26. Since the rigidity of zone 14 increases as additional fluid is introduced into the chambers 26, resistance to "rolling" of the cushion 10 is increased for thus enhancing the safety of the user.

In view of the foregoing, it should be apparent that the cushion 10 provides a safe and practical solution to problems encountered by invalids, wheel chair occupants, drivers of vehicles, and the like when required to sit for long periods on seats of moving vehicles.

Although the invention has been shown and described in what is conceived to be the most practical and preferred method and device, it is recognized that departures may be made therefrom within the scope of the invention, which is not to be limited to the illustrative details disclosed.

Having described my invention, what I claim as new and desire to secure by Letters Patent is:

1. A cushion particularly suited for use in supporting a human body in a seated disposition comprising:

a sealed envelope formed of a pair of similarly configured flexible sheets disposed in superimposed registry and having an endless seam extended about the periphery thereof, said envelope being characterized by a first section extended transversely across said envelope for receiving in supporting relation the buttocks of a seated human body and having defined therein a water-filled, unbaffled chamber from which the water is expelled in response to the weight of a seated human body, and a second section of a thickness slightly less than the thickness of the first section extended transversely across the envelope in juxtaposed parallelism with the first section for receiving water expelled from said unbaffled chamber including support means for supporting the second section against deformation about axes lying in the plane thereof comprising, an array of at least six tubular chambers of uniform cylindrical configurations normally related to the first chamber and extended in juxtaposed parallelism, each having an open end communication with said first chamber for receiving water expelled therefrom and a sealed end opposite said open end for confining the expelled water under pressure, whereby the tubular chambers are adapted to become substantially rigid in response to the weight of the seated body, and means including a sealable port for introducing into said unbaffled chamber water of a quantity sufficient for imparting rigidity to said tubular chambers as the water is expelled from said unbaffled chamber in response to the weight of a human body as the buttocks thereof are received by said first section of said envelope.

* * * * *